US010946674B2

(12) United States Patent
Koehler et al.

(10) Patent No.: US 10,946,674 B2
(45) Date of Patent: Mar. 16, 2021

(54) SEQUENCING OF LOADS USING TEMPERATURE

(71) Applicant: Hewlett-Packard Development Company, L.P., Spring, TX (US)

(72) Inventors: Duane A Koehler, Vancouver, WA (US); Francisco Alcazar, Vancouver, WA (US); Daniel James Magnusson, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/608,419

(22) PCT Filed: Apr. 27, 2017

(86) PCT No.: PCT/US2017/029853
§ 371 (c)(1),
(2) Date: Oct. 25, 2019

(87) PCT Pub. No.: WO2018/199954
PCT Pub. Date: Nov. 1, 2018

(65) Prior Publication Data
US 2020/0189294 A1 Jun. 18, 2020

(51) Int. Cl.
*B41J 29/38* (2006.01)
*B41J 11/00* (2006.01)

(52) U.S. Cl.
CPC ..... *B41J 11/002* (2013.01)

(58) Field of Classification Search
CPC ..... B41J 2/37; B41J 11/002; B41F 3/52
See application file for complete search history.

(56) References Cited

U.S. PATENT DOCUMENTS 5,337,499 A * 8/1994 Isozaki ..... F26B 13/183 34/114
5,789,723 A 8/1998 Hirst
6,600,237 B1 7/2003 Meissner
7,573,206 B2 8/2009 Nicholson et al.
2004/0183880 A1 9/2004 Kito
2005/0134669 A1* 6/2005 Slattery ..... B41J 2/32 347/177
2014/0232797 A1* 8/2014 Onodera ..... B41F 23/042 347/102
2015/0346659 A1* 12/2015 Nagayama ..... B41J 11/0015 101/424.1
2016/0075130 A1 3/2016 Landa et al.

FOREIGN PATENT DOCUMENTS

WO WO-2016154661 10/2016

OTHER PUBLICATIONS

Flicker: Causes, Symptoms, and Cures, Jan. 1, 2007, http://ecmweb.com/lighting-amp-control/—7 pages.

* cited by examiner

*Primary Examiner* — Lam S Nguyen
(74) *Attorney, Agent, or Firm* — Conley Rose PC

(57) ABSTRACT

A sequence of loads within a system is determined during each of multiple time windows based on a determination of each load's temperature to a target value. The sequencing of the loads involves a determination as to whether the length of each time window is long enough to permit all of the loads to be sequentially activated in order to have their temperatures approximate the corresponding target temperatures. In some cases, the sequence of the loads is determined to be one that results in a monotonically changing power profile.

15 Claims, 5 Drawing Sheets

SEQUENCING OF LOADS USING TEMPERATURE

BACKGROUND

Some types of electrical systems can draw a large amount of current. Large printing systems, for example, may include multiple dryers that are turned on and off at a certain rate so as to maintain the temperature of the dryers at a configurable level. Each dryer alone may consume, for example, 500 W (or more) of power each time it is turned on. Some printing systems may include additional high power loads such as heated pressure rollers, which when turned on, may consume even more power than the dryers (e.g., 600 W, 700 W, etc.).

Turning high power loads on and off causes large changes in current. Large changes in current may create excessive "flicker." Flicker is the impression of unsteadiness of visual sensation induced by a light stimulus whose luminance or spectral distribution fluctuates with time. In electrical power distribution systems flicker is the result of large current changes reacting with the power distribution system impedance causing voltage fluctuations. These voltage fluctuations can cause the light output of incandescent lamps to fluctuate and can cause fluorescent lamps to drop out. Light flicker can be visually irritating.

BRIEF DESCRIPTION OF THE DRAWINGS

For a detailed description of various examples, reference will now be made to the accompanying drawings in which.

DETAILED DESCRIPTION

Figure 1:
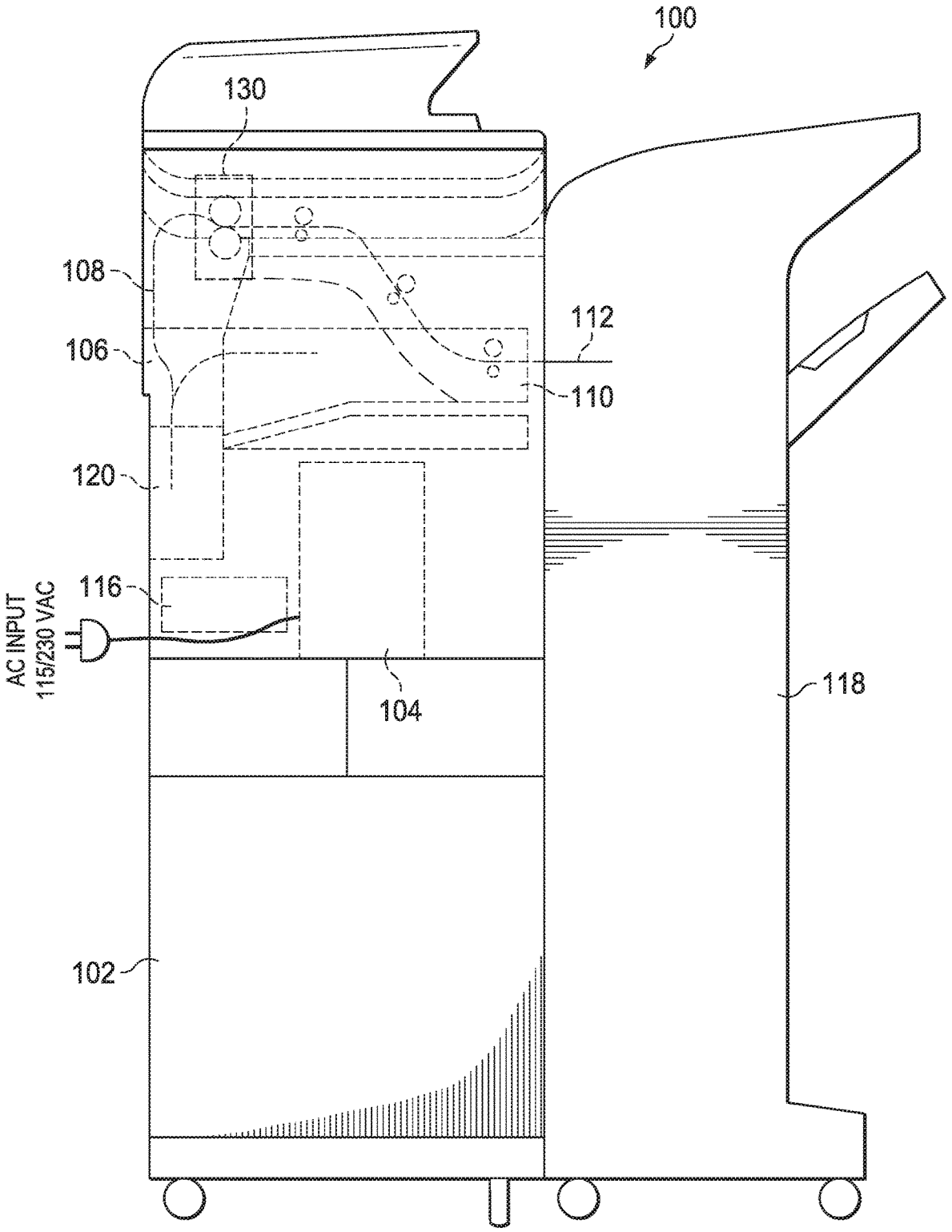
FIG. 1 shows a printing system in accordance with various examples.

In accordance with the disclosed embodiments, an electrical system such as a printer includes multiple loads such as dryers and heated pressure rollers that are operationally sequenced (e.g., turned on and off) in such a manner as to reduce flicker to a level that is not visually irritating. The example system described herein is of a printer, but the disclosed principles apply to other types of electrical systems.

A print job is processed through the printer and control logic internal to the printer determines an appropriate sequence of the printer's higher power loads (e.g., dryers and heated pressure rollers) in each of multiple time windows. The time windows may be relatively short such as 1 second, 2 second, etc. and the sequencing of the loads in any given window may be different from the sequencing of the loads in the immediately prior time window or the subsequent time window. That is, the sequencing of the loads is determined on a time window-by-time window basis during the printing of the print job. Temperature sensors are included in the printer to monitor the temperature of the dryers and heated pressure rollers. Feedback control loops are implemented by the control logic to turn the loads on and off at just such a rate to maintain each such load at or near (e.g., within a threshold range of) a configurable temperature target for the load. Given the amount of time each individual load needs to be on in a given time window to maintain its temperature at approximately its target temperature level, the control logic determines a suitable sequencing of the loads. The sequencing during a given time window may include turning each load on by itself, or the sequence computed by the control logic may include turning multiple loads on concurrently. The sequencing determination made by the control logic prioritizes producing a monotonically increasing or decreasing power profile of the loads during a given window to reduce the size of the total power steps during the window (e.g., the maximum power consumption relative to the minimum power consumption during the time window). As a result of the monotonically changing (increasing or decreasing) power profile during the time windows, the potential for flicker to present a problem is reduced.

Further, if all of the loads can be turned on during a given time window for enough time to maintain their temperatures at the target levels and there would still be time leftover in the time window, then rather than all of the loads being off for a portion for the time window, the control logic automatically may extend the time for at least one of the loads to remain on. One or more of the loads may have a larger thermal time constant than other loads. The thermal time constant is indicative of how fast or slow a load's temperature changes. Extending the operational state of a load with a larger thermal time constant than another load helps to avoid the power profile during the window dropping to zero while not having a detrimental impact on the load from its temperature potentially being higher than it needs to be.

FIG. 1 shows an example of a printing system 100. In this example, the printing system 100 includes a printer device 102 attached to a finisher device 118. The printer device 102 includes a print component 116 that deposits print material on print media. The print material may be a liquid ink, a powder or other type of print agent and the media may be any type of paper, plastic or other type of medium on which an image (e.g., graphics, text, etc.) is to be printed. The print component may comprise an inkjet print mechanism, a laser print mechanism, or another type of print mechanism.

As the print media exits the print component 116, the print medium enters the area of one or more dryers 120. In one implementation, a single dryer 120 is provided but in other implementations, more than one dryer (e.g., two dryers) are provided. An example below assumes that two dryers are provided. As operating voltage is applied to a dryer 120, the dryer warms up which in turn at least partially dries the print media and the print material deposited thereon. By way of an example, each dryer is a 500 W dryer, although the power ratings of the dryers can be other than 500 W and may differ between the two dryers. A temperature sensor may be included for each dryer to measure the temperature of the corresponding dryer.

The print media exits the dryer along a dryer path 106 and can enter the output bin 110 unless the finisher device 118 is attached to the printer device 102, which is the case in this example. Thus, rather than entering the output bin 110, the print media continues along the path 108 and through a heated pressure roller (HPR) 130. In some implementations, the HPR 130 includes two halogen lamps. One lamp may include a 720 W bulb that concentrates heat near the middle of an 8.5" wide sheet of print media. Another lamp may include a 580 W lamp that concentrates heat near the edges of an 8.5" wide sheet of print media. The HPR 130 also may include a belt that rotates around the two lamps and transfers heat from the lamps to the print media. A temperature sensor may be included for each of the two lamps. A thermal cutoff switch may also be included to remove power from the lamps under a fault condition (e.g., excessive heat), and an optical sensor may be included to detect print media jams. The heat generated by the lamps of the HPR 130 further dries the print media. Although the above example includes two halogen lamps of 580 W and 720 W, other embodiments may include a different number of lamps (one or more), a different power rating for each lamp (i.e., different than 580 W and 720 W) and may include different types of heat generating lamps besides halogen lamps.

The print media exits the print device 102 along path 112 and into the finisher device 118. The finisher device 118 may perform any of a number of functions such as collation, stapling, etc. Although not shown, the print device 102 also includes a power supply to convert an incoming alternating current (AC) voltage to one or more direct current (DC) voltages for use by the various loads (e.g., the dryers 120 and the halogen lamps 130) of the printing system 100.

The print device 100 also includes a controller 104, which as explained below determines which loads are to be on at any given time during each of a series of time windows when processing a print job for printing. The controller 104 determines the sequence for each time window and then causes the various loads to be turned and off in accordance with the sequences. In some cases, the controller 104 may turn a given load on and off through assertion of a control signal to a power switch that supplies operating voltage to the respective load.

Figure 2:
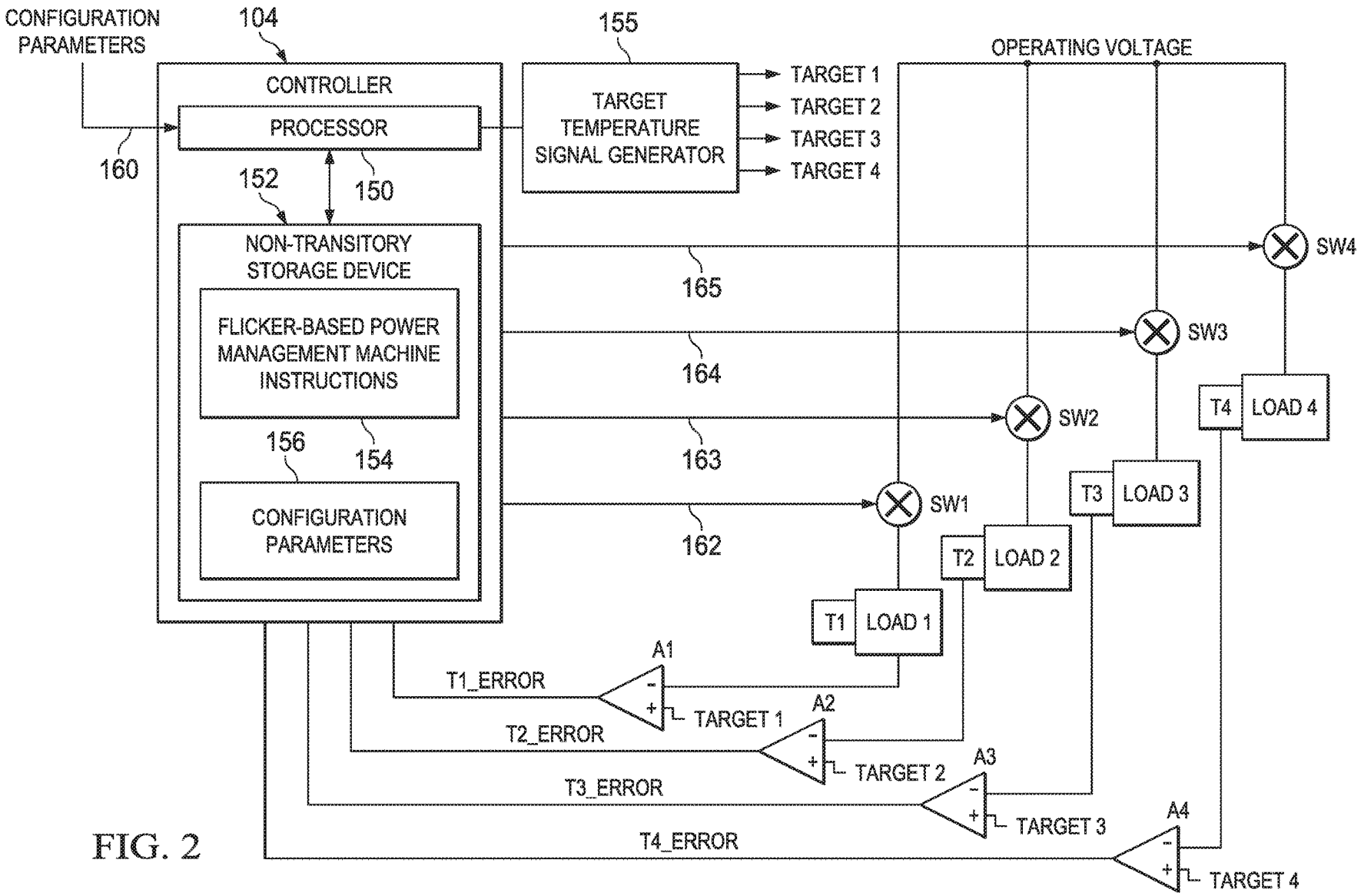
FIG. 2 illustrates a controller to control loads in accordance with various examples.

FIG. 2 shows an example of the controller 104 as comprising a processor 150 coupled to a non-transitory storage device 152. The non-transitory storage device 152 may comprise volatile storage such as random access memory (RAM) or non-volatile storage such as a solid state drive (SSD), magnetic storage such as hard disk drive, etc. The non-transitory storage device 152 stores flicker-based power management machine instructions 154, which are executed by processor 150 to perform some or all of the functionality described herein as attributed to the controller 104 in determining how to sequence loads Load1-Load4 in each of multiple time windows to process a print job.

The controller 104 in the example of FIG. 2 controls four separate loads designated as Load1, Load2, Load3, and Load4. Other examples include a different number of loads. The four loads Load1-Load4 may include two dryers 120 and the two halogen lamps of the HPR 130. A temperature sensor is included in, on, or near each load to measure the temperature of the corresponding load. Temperature sensor T1 is provided for Load1. Temperature sensor T2 is provided for Load2. Temperature sensor T3 is provided for Load3. Temperature sensor T4 is provided for Load4.

An error amplifier also is provided for each load to amplify the difference between the load's temperature sensor signal and a target temperature signal. In the description that follows, each error amplifier may be implemented as an analog-comparing amplifier, as digital circuitry, by software executed on a processor, or by some combination thereof. Similarly, the target value and error signal discussed below may comprise an analog voltage, a binary value produced by digital hardware, by software executed on or processor, or by some combination thereof. Amplifier A1 amplifies the difference between the temperature signal from T1 and Target1 to produce a T1_Error signal indicative of the difference between the current temperature of Load1 and its target temperature setting, Target1. Amplifier A2 amplifies the difference between the temperature signal from T2 and Target2 to produce a T2_Error signal indicative of the difference between the current temperature of Load2 and its target temperature setting, Target2. Amplifier A3 amplifies the difference between the temperature signal from T3 and Target3 to produce a T3_Error signal indicative of the difference between the current temperature of Load3 and its target temperature setting, Target3. Amplifier A4 amplifies the difference between the temperature signal from T4 and Target4 to produce a T4_Error signal indicative of the difference between the current temperature of Load4 and its target temperature setting, Target4. The target temperature signals Target1-Target4 are generated by the target temperature signal generator 155.

Configuration parameters 160 for a given print job to be processed by the controller 104 are programmed into the controller and stored in configuration parameter storage 156 in the non-volatile storage device 152. The configuration parameters may be provided to the controller 104 at the beginning of a print job. The configuration parameters may include a target temperature for each load, or the controller 104 may compute a target temperature based on other configuration parameters and/or print job specific characteristics. The target temperature signal generator 155 generates output DC voltage signal levels proportional to the target temperature for each load. The target temperature signal generator 155 may comprise configurable DC-to-DC voltage converters, configurable voltage divider networks (e.g., resistor divider networks), or other circuitry to generate the target temperature signals for the error amplifiers.

The temperature error signals (Tx_Error) from the error amplifiers A1-A4 are provided to the controller 104 and the controller 104 responds to the temperature error signals by turning the individual loads on and off in an attempt to operate the loads so as to control the load temperatures so that the Tx_Error signals are approximately 0V (which corresponds to a temperature signal being equal to the corresponding target temperature signal). Power switches SW1, SW2, SW3, and SW4 are provided for each corresponding load Load1-Load4. Control signals 162, 163, 164, and 165 are generated by the controller 104 to turn on or off each of the switches SW1-SW4 to thereby turn power off the loads.

When the printing system 100 executes a print job, the controller 104 determines the sequence of the loads (e.g., Load1-4) during each of a plurality of consecutive time windows. As noted above, time windows may be of any length such as 1 second, 2 seconds, etc. Further, one of the input configuration parameters 160 to the controller may comprise a "maximum count" value. The maximum count value may comprise an 8-bit integer value and thus may be in the range of 1 to 255, although other sizes and ranges of the maximum count value are possible as well. The maximum count value represents the number of subdivisions of each time window. Loads can be turned on or off during coincident with each such subdivision. In the example of a 2 second time window and a maximum count value of 255, each 2 second time window is divided into 255 subdivisions of 2/255 seconds for each subdivision (i.e., 0.00784 seconds). The maximum count value defines the resolution at which loads can be turned on and off within a given time window. This result then may be rounded to the nearest AC half-cycle to allow each load to be switched on or off at the zero-crossing time of the AC waveform. Switching during the zero-crossing event reduces switching currents and power line harmonics.

The temperature error signals Tx_Error from the error amplifiers A1-A4 may be converted into a count value by, for example, the controller 104 or other circuitry between the error amplifiers A1-A4 and the controller. The count value (or simply "count") computed for each load's temperature error signal specifies the number of counts that that load should be on during the next time window in order to maintain or force the temperature of the corresponding load to equal its target temperature, Targetx. If the temperature of the load already is at its target temperature, the count value for that load may be 0 (or a small positive integer value). If the temperature of the load is below its target temperature, the count value for that load will be computed to be a positive count value as a function of the magnitude of Tx_Error signal—larger Tx_Error signals result in larger count values.

Figure 3:
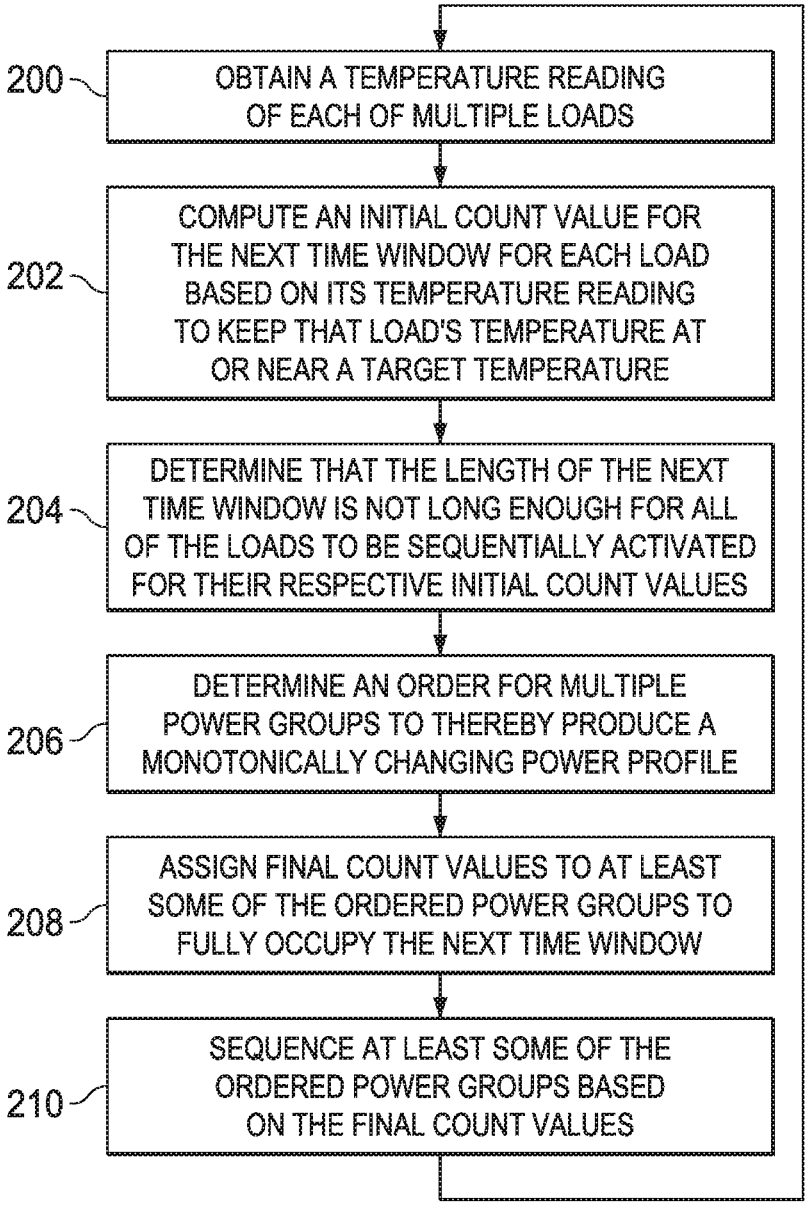
FIG. 3 shows a method in accordance with an example.

FIG. 3 illustrates a method in accordance with various examples. The operations may be performed in the order shown, or in a different order. Further, the operations may be performed sequentially, or two or more of the operations may be performed concurrently. The method of FIG. 3 is described below also with reference to the system diagram of FIG. 2.

At the beginning of each time window, or at the very end of the previous time window, at 200 the method comprises obtaining a temperature reading of each of multiple loads during a given time window. This operation may comprise a temperature sensor for each load providing a temperature sensor signal, comparing the temperature sensor signal to the target temperature signal, and generating a temperature error signal.

At 202, for each of the loads, the method includes computing an initial count value for the given time window based on the load's temperature reading to force that load's temperature to be at or near a target temperature for the load. This operation may comprise the controller 104 converting the temperature error signal for each load to a corresponding count value proportional to the temperature error signal. The initial count value for each load represents the count value for the given time window that, if honored by the controller 104, would cause the corresponding load to be at or near its target temperature.

The method may include determining whether the length of the given time window is long enough for all of the loads to be sequentially activated for their respective initial count values. This determination may include summing the individual initial count values for the various loads and comparing the sum to the maximum count value for the time window. If the time window is long enough to accommodate sequencing each of the loads for its initial count value during the time window, then each load can be turned on for the its initial count value, although as explained below, one more of the loads may be turned on during the given time window for a time period that is longer than its computed initial count value.

At 204, the method includes determining that the length of the given time window is not long enough for all of the loads to be sequentially activated for their respective initial count values. Responsive to this determination, at 206 the method includes determining an order for a plurality of "power groups" to thereby produce a monotonically changing power profile during the current time window. The power profile is the time sequence of the power consumption of the loads during the time window. Each power group includes one or more of the loads and at least one power group includes more than one concurrently active load. Table I below provides an example of a set of power groups.

TABLE I

| POWER GROUPS | | |
|---|---|---|
| Power Group | Which loads are powered | Power Value (watts) |
| 0 | No Loads | 0 |
| 1 | Load1 | 720 |
| 2 | Load2 | 580 |
| 3 | Load3 | 500 |
| 4 | Load4 | 500 |
| 5 | Load3 + Load4 | 1000 |
| 6 | Load2 + Load3 | 1080 |
| 7 | Load2 + Load4 | 1080 |
| 8 | Load1 + Load3 | 1220 |
| 9 | Load1 + Load4 | 1220 |
| 10 | Load1 + Load2 | 1300 |

This example includes 10 power groups and their corresponding power consumption values. Four of the power groups are individual loads comprising Load1 (720 W), Load2 (580 W), Load3 (500 W), and Load4 (500 W). Load1 and Load2 may represent the halogen lamps mentioned above and Load3 and Load4 may represent the 500 W dryers noted previously. Another six power groups comprise combinations of the loads and their corresponding combined power consumption. For example, with Load2 and Load3 on concurrently, the combined power consumption is 1080 W. In this example, the lowest power consumption power group (other than power group 0 with no loads on on) is 500 W for either Load3 or Load4, and the highest power consumption power group is 1300 W for both Load1 and Load2 being on concurrently.

Additional combinations are possible, but may exceed the maximum power capacity of the system. The maximum power value for the system may be another component of the configuration parameters 160 provided to the controller 160. Turning loads on that would collectively exceed the maximum power value may cause a circuit breaker to trip. If the maximum power value is, for example, 1300 W, then only those loads and combination of loads that are below the 1300 W are included as possible power groups by the controller 104.

In order to produce the smoothest power profile, only a subset of power groups may be permitted for a particular operating condition. For example, if all loads are at or near their target temperatures, then only power groups 0 through 4 may be allowed. Based upon the values shown in Table I, constraining to only power groups 0-4 will bound the maximum power variation to 720 W. As another example, if the system had been off for a considerable period of time such that all temperatures are low relative to the target temperature, then only power groups 5 through 10 are allowed. This will bound the power variation to 300 W, per the power values shown in the table above.

The determination made in operation 204 was that the initial count values for the various loads that would be needed to keep each of the loads operating at or near its target temperature are collectively longer than the maximum count value for the entire time window. Thus, in order to turn all of the loads for the number of counts each load needs, multiple loads should be turned on concurrently. The use of the power groups provides the controller 104 with sufficiently flexibility to honor the initial count values for the loads during the time window.

As noted above, the controller 104 also determines the order for which the various power groups should be sequenced during the given time window. To reduce the effects of flicker, the controller 104 prioritizes sequencing the power groups in a monotonically changing manner during the time window. The sequence produces a monotonically increasing power profile or a monotonically decreasing power profile. A monotonically increasing power profile is one in which as the power groups for a given time window are sequenced, the power values for the power groups increases (e.g., 700 W followed by 1000 W followed by 1260 W). A monotonically decreasing power profile is one in which as the power groups for a given time window are sequenced, the power values for the power groups decreases.

Whether the controller 104 implements a monotonically increasing or decreasing power profile for a given time window depends on the ending power value of the immediately previous time window. If the power value at the end of the previous time window is high relative to the power values of the power groups available to the controller 104, the controller sequences power groups in the next time window in a monotonically decreasing power profile. For example, if the ending power value of the last time window is equal to the highest power value of any of the power groups (e.g., 1260 W in the example of Table I), then a monotonically decreasing power profile is implemented in the next time window by the controller 104. In one embodiment, if the ending power value of the previous time window is greater than the median value of all available power profiles or is a power value for which there are more power groups at power values less than the ending power value than above it, then a monotonically decreasing power profile is implemented. In general, the controller will produce a behavior where a monotonically increasing profile will be followed by a monotonically decreasing power profile, and vice-versa. This will cause the power profile over multiple time windows to vary up and down in a smooth manner.

Conversely, if the power value at the end of the previous time window is low relative to the power values of the power groups available to the controller, the controller sequences power groups in the next time window in a monotonically increasing power profile. For example, if the ending power value of the last time window is equal to the lowest power value of any of the power groups (e.g., 500 W in the example of Table I), then a monotonically increasing power profile is implemented in the next time window by the controller 104. In one embodiment, if the ending power value of the previous time window is less than the median value of all available power profiles or is a power value for which there are more power groups at power values greater than the ending power value than below it, then a monotonically increasing power profile is implemented in the next time window.

As described above, the order in which the power groups will be used is determined. At 208 the method includes assigning final count values to at least some of the ordered plurality of power groups so that the time window for which the controller 104 has determined the sequence of power groups includes an active power group at all times during the first time window. At least one of the assigned final count values for a given load may be higher than the count value initially requested for that load. The final count values assigned to the power groups dictate how long the loads of each such power group will be on when that particular power group is activated.

To the extent that there are multiple possible ways to assign final count values to a sequence of power groups in order to honor the initial count values for each load, in some implementations the controller 104 computes a score for two or more sequences of power groups. The score is indicative of the likelihood that flicker will be perceived by and annoying to people. In one implementation, the score is calculated as a weighted average of the difference between the highest and lowest power values for a sequence of power groups and, for each load, the difference between the initial count value and the count values assigned to that load among the various power groups of which the load is a member. For a given possible sequence of power groups and with each power group having a particular power value (e.g., as shown in the example of Table I), the difference between the largest power value and the smallest power value is Pstep_max. A given load may be included in multiple power groups in a possible sequence. For example, a sequence of power groups may include Load1, Load2, Load3, Load4, Load2+Load3, and Load2+Load4. In this illustrative sequence Load2 is present in three different power groups. The total number of counts assigned to Load2 is the sum of the number of counts assigned to each of these three power groups. The total number of counts assigned to a given load may or may not equal the initial count value determined for the load based on its temperature reading. For a given particular sequence of power groups, the difference between a particular load's initial count and the total number of counts assigned to that load among the various power groups of which the load is a member is given as Loadx_Error (where "x" is the number of the load). The score for a particular sequence of power groups may be computed as:

$$\text{Score}=W1*\text{Pstep}_{max}+W2*\text{Load1}_{Error}+W3*\text{Load2_Error}+W4*\text{Load3_Error}+W5*\text{Load4_Error}$$

where W1, W2, W3, W4 and W5 are weights assigned to each component of the score. The weights can be adjusted as desired. In one example, the weights for the loads that have a lower thermal time constant may be set higher than weights for the loads that have a higher thermal time constant. Of the various possible sets of counts assigned to the power groups, the sequence of power groups that has count values that result in the lowest score is selected or computed by the controller 104 to implement in the next time window.

In one example, the controller 104 may perform a minimization process to determine the count values to assign to the various power groups. For example, the controller 104 may determine the set of count values that result in the lowest possible score. In some cases, the count value assignments may result in a sequence of power groups that results in the lowest possible score, while in other cases, the count value assignments result in an acceptable sequence but one that does not necessarily have the lowest possible score. The minimization process may functions differently based on the magnitude to which the requested count exceeds the maximum available count for the time window. For example, in an example in which the count exceeds the maximum available count by less than a threshold amount (e.g., the threshold equals to the maximum available count for the window), the process may first assign count values to power groups 5-10 (see Table I above). In this scenario, power groups 0-5 may not be used for this system condition. In this example, counts are assigned o power group 10 (Load1+Load2) to assign a preconfigured minimum number of counts to Load1 and Load2, then choose from one of power groups 5-9 to satisfy the balance of the counts to Load1 and Load 2, and then apply the balance of available counts (if any) to power group 5 (Load3+Load 4).

If the count exceeds the maximum available count by more than the threshold amount (e.g., the threshold equals to the maximum available count for the window), the process may assign a preconfigured minimum number of counts to power group 10 and then assign the balance of the count values only to power groups 6-10 (e.g., divided equally). This may create a result where the magnitude of count values assigned to some loads (e.g., the lower thermal time constant loads such as the HPR lamps) may be greater than the requested counts for those loads. The process may be iterative. In each iteration, the process may assign counts to power groups that otherwise might have been assigned power group 10 and divide those counts evenly among the various such power groups. The sum of the errors (assign count values less requested count values) of the lower thermal time constant loads such as the HPR lamps is computed. The newly computed sum may be compared to the corresponding sum result from the previous iteration. If the polarity of the sums is opposite (e.g., one sum was positive and the other negative), then in the next iteration, the process decreases counts assigned to some of the power groups back to power group 10. If the polarity of the sums is the same, additional counts are shifted from power group 10 to power groups 6-9 (divided evenly). The process may continue until the magnitude of the sum count values assigned to the lower thermal time constant loads (e.g., HPR lamps) less their respective requested counts decreases. The controller 104 then may choose the particular power group sequence and set of count values that has the lowest score.

At 210, the method comprises sequencing at least some of the ordered plurality of power groups during the time window using the assigned final count values. This operation includes powering on and off the various loads per the order and number of counts determined by the controller. The controller 104 asserts the control signals 162-165 to the various power switches to turn power on and off to the loads in accordance with the computed power group sequence. Control then loops back to 200 and the process repeats for the next time window.

Figure 4:
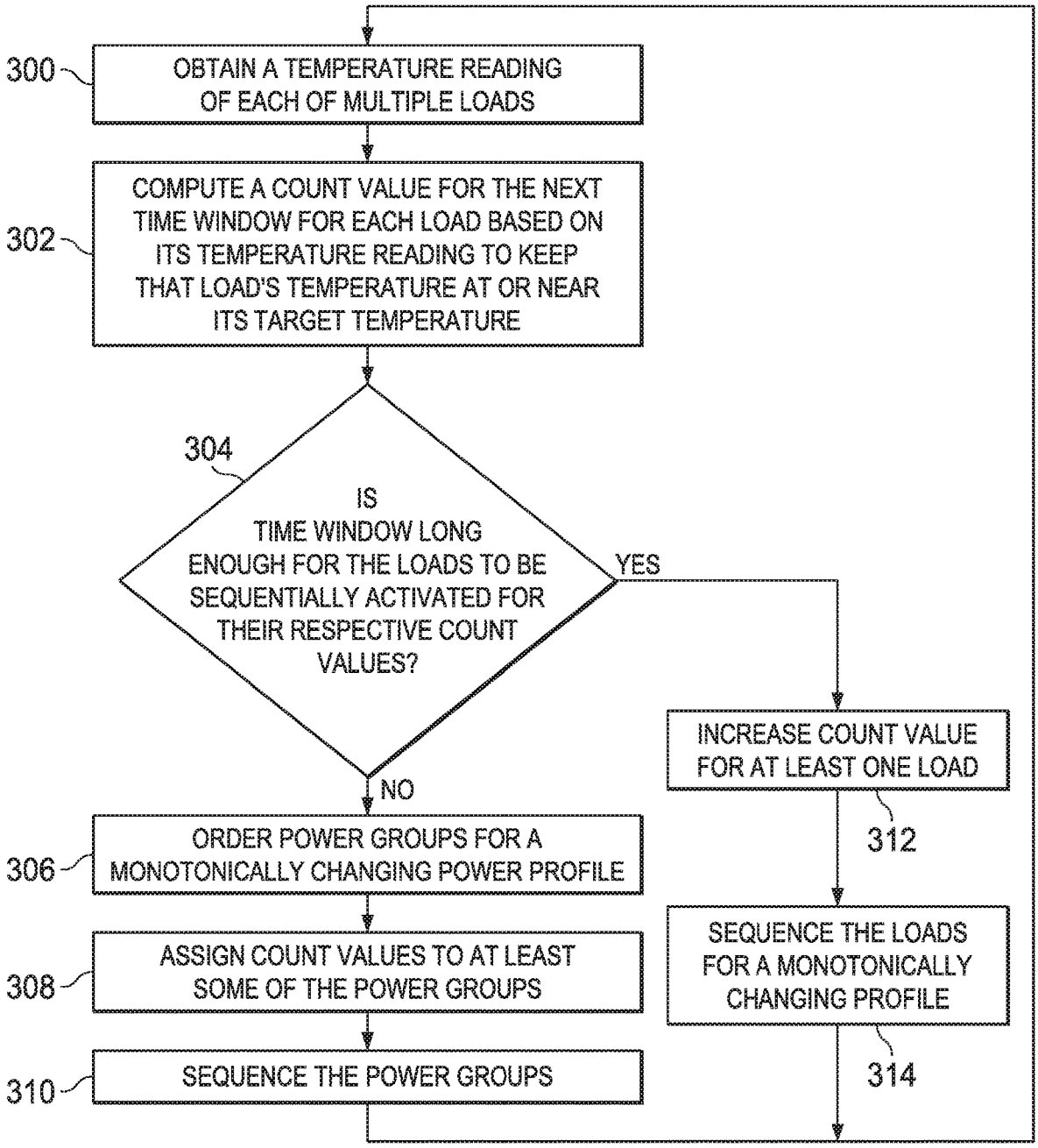
FIG. 4 shows a method in accordance with another example.

FIG. 4 illustrates another method for determining the sequence of loads during the time windows to minimize the effects of flicker. The operations may be performed in the order shown, or in a different order. Further, the operations may be performed sequentially, or two or more of the operations may be performed concurrently. The operations shown in FIG. 4 may be performed by the controller 104.

Operations 300 and 302 are the same or similar as operations 200 and 202 in FIG. 3. After obtaining temperature measurements of the various loads and computing the number of counts needed for each load to remain at tis target temperature, at 304 the method includes determining whether the time window is long enough for the loads to be sequentially activated for their respective count values. If the time window is not long enough, then operations 306, 308, and 310 are performed. At 306, the controller 104 determines the order of the power groups so as to produce a monotonically changing power profile as described above. Count values are then assigned to at least some of the power groups also as described above. The loads of the power groups are then sequenced (turned on and off) at 310 during the time window. This operation may comprise the controller 104 asserting the control signals 162-165 to the switches SW1-SW4.

Figure 5:
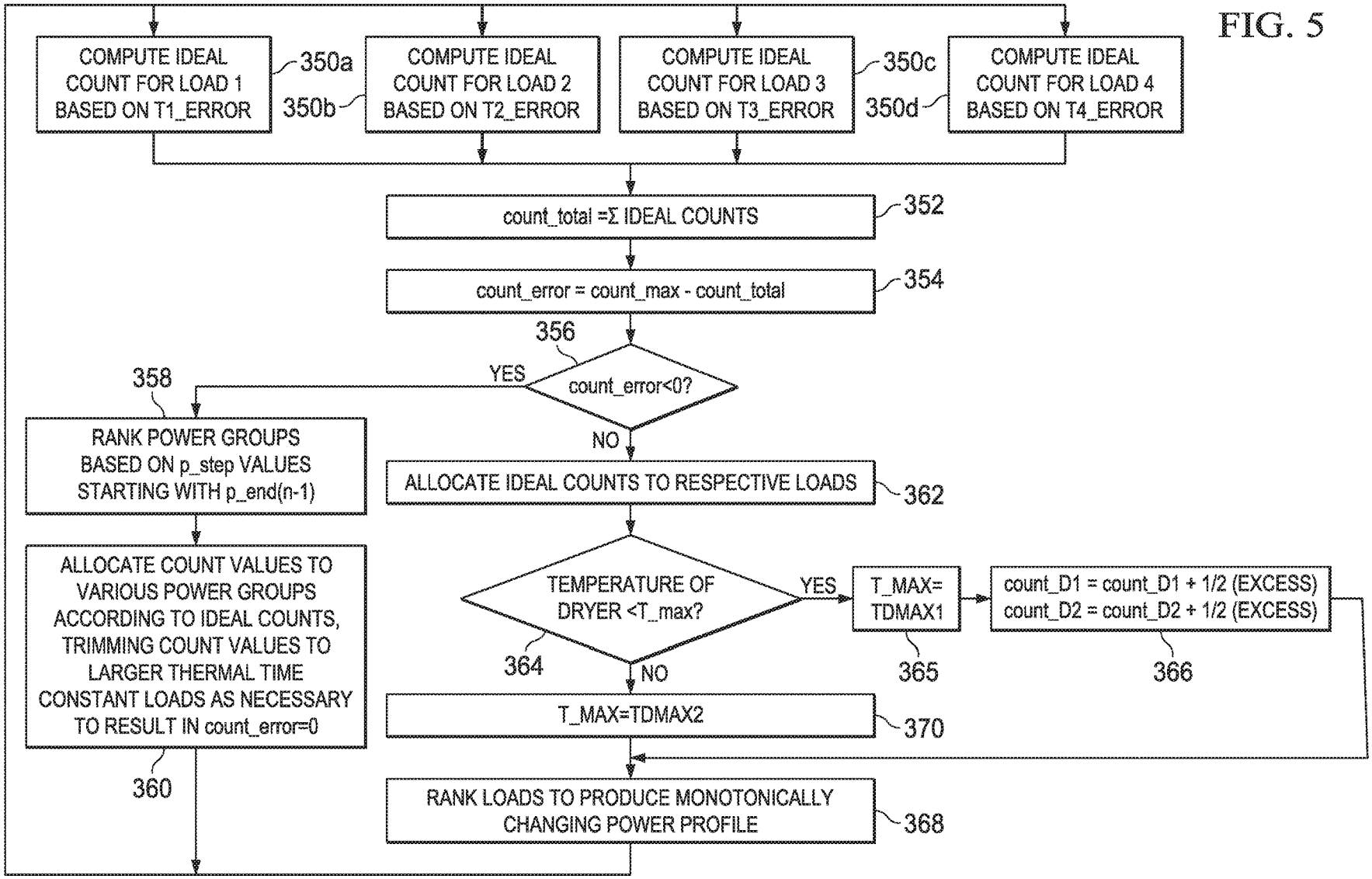
FIG. 5 shows an example method with additional detail.

However, if the time window is long enough to be able to sequence the individual loads for the initially computed count values without having to have multiple loads on concurrently, then control passes to 312 in which the count value for at least one of the loads is increased from its initially determined value. The initial count of at least one load is increased so that all the sum of all counts assigned to the loads to be powered on during the time window equals the maximum count value for the time window (e.g., 255). An example of a technique for increasing the count value of a load is illustrated in FIG. 5 and discussed below. The controller 104 then causes the loads to be sequenced in a monotonic order and for the count values determined at 302 and possibly increased per 312. A monotonic order of the loads is determined as explained previously. Upon sequencing the power groups at 310 or the loads at 314, control loops back to 300 to repeat the method for the next time window. This process will result in the consumption of all available count values, and is used to reduce flicker at the expense of allowing the temperature of the dryer to rise slightly above its target value. This process may be used whenever the dryer temperature is between two threshold values. Once the dryer temperature reaches the upper threshold, then power group 0 is again permitted in order to allow the dryer temperature to return toward its target value. When the dryer temperature reaches the lower threshold value, then power group 0 is prevented. In this way, hysteresis is provided to allow the dryer temperature to float between the two threshold values. This will constrain the dryer temperature to an acceptable range, while greatly minimizing power line flicker.

FIG. 5 illustrates yet another example of a method for determining the sequencing the loads within each time window. The controller 104 performs some or all of the operations shown. In the example of FIG. 5, four loads may need to be sequenced and at 350*a*, 350*b*, 350*c*, and 350*d*, the ideal count value for each load is computed based on the load's Tx_Error signal. The ideal count value for each load represents the portion of the next time window that that load should be on in order to maintain or force its temperature to be equal or approximately equal to its target value. The ideal count value for Load1 is computed at 350*a* based on the T1_Error signal. The ideal count value for Load2 is computed at 350*b* based on the T2_Error signal. The ideal count value for Load3 is computed at 350*c* based on the T3_Error signal. The ideal count value for Load4 is computed at 350*d* based on the T4_Error signal.

At 352, the various ideal count values are summed to compute a count_total value. The count_total value represents the aggregate number of counts that would be required to sequentially activate all four loads. At 354, the count_total value is subtracted from the maximum count value for the time window to compute a count_error value. The count_error value may be positive if all four loads need not be sequentially activated for the entire time window, 0 if all four loads need to be sequentially activated for the entire time window, or negative if the time window is not long enough to for all of the loads to be sequentially activated.

At 356, the controller 104 determines whether the count_error is less than 0 (i.e., a negative value). Responsive to the count_error value being less than 0, at 358 the controller 104 ranks the power groups based on "P_step" values starting P_end(n−1). The value P_end(n−1) represents the power consumption that occurred at the end of the last time window (n is an index value that represents the current time window and n−1 represents the previous time window). The power consumption at the end of the last time window may be 0 if no loads were activated at the end of the time window or a positive value equal to the power rating of the last load or power group to be activated during the last time window. For each power group, the controller 104 calculates a P_step value as the difference between the power rating for that power group and P_end(n−1). The controller 104 ranks the power groups in a monotonic fashion from the P_end(n−1) as explained above.

At 360, the method includes allocating count values to various power groups according to the ideal count values, while if necessary, adding count values to the loads with larger thermal time constants to result in the count_error for the time window to be 0. In some cases, the allocation of count values to power groups may be to power groups that have multiple loads and not to power groups with only one load. The addition of extra count values to the larger thermal time constant loads helps to ensure that at least one load is on at all times during the time window and thus the power consumption during the time window does not drop to 0, which otherwise may result in a problem with flicker.

If at 356 the count_error value is greater than 0 (and in some implementations greater than or equal to 0), then at 362, the method includes allocating the ideal count values (determined from 350*a*-350*d*) to their respective loads. That the count_error value is greater than 0 means that the time window is sufficiently long enough as to accommodate all of the loads being activated sequentially and no loads need to be activated concurrently as part of a multi-load power group. However, with the activation of all of the loads for their ideal count values, extra counts may remain for the time window. To avoid a potential flicker problem in which the power consumption drops dramatically, the controller 104 may allocate the excess counts to certain loads. In one example, at 364, the method includes determining whether the temperature of one of a dryer (or at least one of the dryers to the extent that there are multiple dryer loads in the system), is less than a configurable maximum temperature value (T_max). In this example, the dryers have a larger thermal time constant than the HPR lamps and thus the excess counts in the time window are allocated to the dryers, but only if the temperature of the dryer(s) has not exceeded the maximum allowable temperature. In some embodiments, the temperature of each dryer is approximately equal as the dryers are in close proximity to one another so that only determining whether the temperature of one of the dryers is less than T_max may be necessary at 364. The value of T_max can be initially programmed at, for example, the beginning of a print job to a value of TDmax1, which may be a temperature value that is larger than the dryer is likely to need to operate at for normal printing operations, but a value that, for safety, should not be exceeded.

If the dryer temperature is less than T_max, then at 365 the method includes setting/resetting T_Max to be the value of TDmax1 and at 366, increasing the count value for each dryer so as to allocate one-half of the excess counts to each dryer. If, however, the dryer temperature is greater than T_max, then the controller does not allocate the excess time window counts to the dryers and the power consumption will, in this scenario, drop to 0. The method of FIG. 5 employs hysteresis for the comparison of the dryer temperature to T_max. At 370, the controller 104 resets the value of T_max to a different value (TDmax2). In some cases, the value TDmax2 is less than the initial T_max value of TDmax1. Like TDmax1, TDMax2 also is larger than the temperature that the dryer is likely to need to operate at for normal printing operations, but is smaller than TDMax1. With each iteration through the method of FIG. 5, with the dryer temperature exceeding T_max, the dyers will not be used for allocation of excess time window counts until their temperature falls below T_max (which is now set at a lower temperature threshold of TDMax2). When the dryer temperature eventually does fall below TDMax1, then as noted above at 365 the dryers' T_max threshold is adjusted back to the higher value of TDMax1.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A method, comprising:

for a first time window, obtaining a temperature reading of each of multiple loads;

for each of the loads, computing an initial count value for the first time window based on the load's temperature reading to force that load's temperature to be at or near a target temperature for the load;

determining that a length of the first time window is not long enough for all of the loads to be sequentially activated for their respective initial count values;

responsive to determining that the length of the first time window is not long enough for all of the loads to be sequentially activated for their respective initial count values, determining an order for a plurality of power groups to thereby produce a monotonically changing power profile, wherein each power group includes one or more of the loads and at least one power group includes more than one concurrently active load;

assigning final count values to at least some of the ordered plurality of power groups so that the first time window includes an active power group at all times during the first time window; and sequencing at least some of the ordered plurality of power groups during the first time window using the assigned final count values.

2. The method of claim 1 further comprising, for a second time window:

obtaining temperature readings of the loads and computing a new set of initial count values to force the loads' temperatures to be at or near corresponding target temperatures;

determining that the length of the second time window is longer than needed for all of the loads to be sequentially activated for their respective new set of initial count values; and responsive determining that the length of the second time window is longer than needed for all of the loads to be sequentially activated for their respective new set of initial count values, increasing the new initial count value for at least one of the loads and sequencing the loads in an order to thereby produce a monotonically changing power profile.

3. The method of claim 2, wherein increasing the new initial count value for the at least one of the loads comprises increasing the initial count value for the load that has a thermal time constant for which no other of the multiple loads has a larger thermal time constant.

4. The method of claim 2, wherein increasing the new initial count value for the at least one of the loads comprises increasing the initial count value so that the a sum of all of the new initial count values for the loads equals a total count value corresponding to the length of the second time window.

5. The method of claim 1, wherein assigning the final count values comprises computing a score for each of a plurality of sequential combinations of the power groups and determining the final count values using the combination of power groups that has a lowest score.

6. A printing system, comprising:

a print component to deposit print material on a print media;

a plurality of drying components to dry the print material on the print media;

a plurality of temperature sensors including a temperature sensor for each of the plurality of drying components; and a controller coupled to the plurality of temperature sensors and the plurality of drying components, wherein when operative, the controller:

obtains a temperature reading from each temperature sensor;

computes a count value for a first time window for each of the plurality of drying components based on the temperature reading of its corresponding temperature sensor to force that drying component's temperature to be at or near a target temperature;

determines that a length of the first time window is long enough for all of the plurality of drying components to be sequentially activated for their respective count values; and responsive to the determination that the length of the first time window is long enough for all of the plurality of drying components to be sequentially activated for their respective count values, increases the count value for at least one of the drying components and sequences the drying components in an order to thereby create a monotonically changing power profile.

7. The printing system of claim 6, wherein the controller includes storage containing a list of a plurality of power groups, each power group identifying one or more drying components and, for each power group, a power consumption value of the one or more drying components.

8. The printing system of claim 7, wherein, when operative, the controller:

obtains a second set of temperature readings from the temperature sensors for a second time window and computes a second set of new count values for the drying components based on the second set of temperature readings;

determines that the length of the second time window is not long enough for all of the plurality of drying elements to be sequentially activated for their respective new count values;

determines an order for a plurality of the power groups to produce a monotonically changing power profile, assigns final count values to at least some of the ordered plurality of power groups so that the second time window includes an active power group at all times during the second time window; and causes at least some of the ordered plurality of power groups to be activated during the second time window based on the assigned final count values.

9. The printing system of claim 6, wherein, when operative, the controller increases the count value for the at least one of the drying components responsive to the temperature sensor of that drying component providing a temperature reading below a threshold.

10. The printing system of claim 9, wherein, when operative and responsive to the temperature sensor of at least one of the drying components providing the temperature reading below the threshold, the controller lowers the threshold for use in a subsequent time window.

11. The printing system of claim 6, wherein, when operative, the controller determines that the length of the first time window is longer than needed for all of the plurality of drying components to be sequentially activated for their respective count values by addition of the count values for each of the plurality of drying components to produce a sum and subtraction of the sum from a configurable maximum count value.

12. A non-transitory storage device containing machine instructions to operate a printing system, wherein when executed, for each of multiple time windows, the machine instructions cause a processor to:

obtain a temperature reading from each of a plurality of temperature sensors, each temperature corresponding to one of a plurality of drying components in the printing system;

compute a count value for each of the plurality of drying components based on the temperature reading of its corresponding temperature sensor to keep that drying component's temperature at or near a configurable target temperature;

determine whether a length of the time window is long enough for all of the plurality of drying components to be sequentially activated for their respective count values;

responsive to the length of the time window determined to be long enough, sequence the drying components during the time window for a period time for each drying component corresponding to its count value; and responsive to the length of the time window determined not to be long enough, rank power groups so as to implement a monotonically changing power profile, each power group including one or more drying components, allocate count values to at least some of the ranked power groups, and sequence the ranked power groups of drying components based on the allocated count values.

13. The non-transitory storage device of claim 12, wherein when executed, the machine instructions cause the processor to allocate the count values to the at least some of the ranked power groups while giving priority to drying components that have shorter thermal time constants than drying components that have longer thermal time constants.

14. The non-transitory storage device of claim 12, wherein when executed and responsive to the length of the time window determined to be longer than needed, the machine instructions cause the processor to increase the count value for at least one of the drying components so that a sum of the count values for the time window equals to a total allocation of count values to the time window.

15. The non-transitory storage device of claim 12, wherein when executed, the machine instructions cause the processor to compute the count value for each of the plurality of drying components based on a difference between the temperature reading of the corresponding temperature sensor and a configurable target temperature for the corresponding drying component.

* * * * *